US007114826B1

(12) United States Patent
Lilly

(10) Patent No.: US 7,114,826 B1
(45) Date of Patent: Oct. 3, 2006

(54) LIGHT ROPE CROWN MOLDING

(76) Inventor: Donald W. Lilly, 1070 E. Indiantown Rd., Suite 310, Jupiter, FL (US) 33477

( * ) Notice: Subject to any disclaimer, the term of this patent is extended or adjusted under 35 U.S.C. 154(b) by 182 days.

(21) Appl. No.: 10/948,246

(22) Filed: Sep. 24, 2004

Related U.S. Application Data

(60) Provisional application No. 60/505,109, filed on Sep. 24, 2003.

(51) Int. Cl.
*F21S 8/00* (2006.01)

(52) U.S. Cl. ..... 362/146; 362/147; 362/151; 362/576

(58) Field of Classification Search ..... 362/146, 362/147, 151, 240, 576, 581; D26/72, 74
See application file for complete search history.

(56) References Cited

U.S. PATENT DOCUMENTS 4,600,975 A * 7/1986 Roberts ..... 362/147
5,226,724 A 7/1993 Kanarek
5,701,236 A * 12/1997 Viviano ..... 362/576
5,823,655 A 10/1998 Brooks
5,908,179 A 6/1999 Fimbres
6,123,443 A 9/2000 Conway
6,173,517 B1 1/2001 Eibner et al.

* cited by examiner

*Primary Examiner*—Stephen F Husar
(74) *Attorney, Agent, or Firm*—James Creighton Wray

(57) ABSTRACT

The present invention is an apparatus for providing indirect illumination to a building interior or exterior using crown molding with specialized grooves for holding light ropes or other types of light sources. The invention generally consists of modular pieces of crown molding with an elongated groove in a top surface running parallel to the front surface. A light rope or other types of illumination are installed in the groove and provide indirect light on the wall, ceiling or other objects above the crown molding. Molding may also be used as picture frame and shelving accent lighting. Clips hold the light rope or other source of illumination inside the groove.

23 Claims, 12 Drawing Sheets

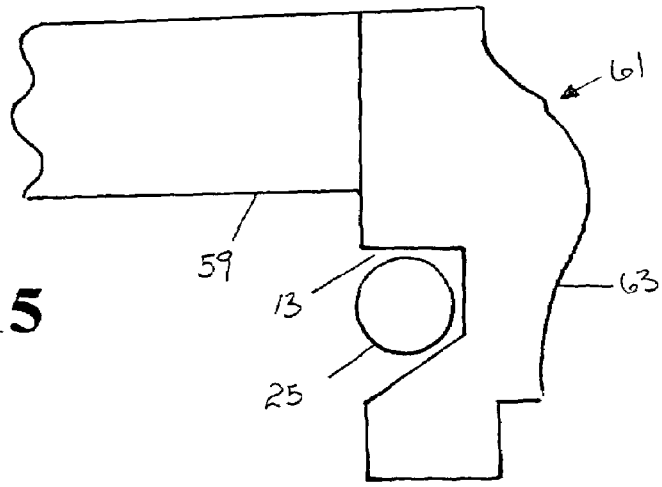
Figure 15
Figure 16
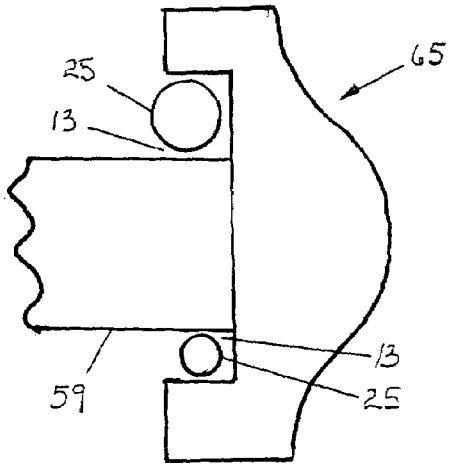
Figure 17
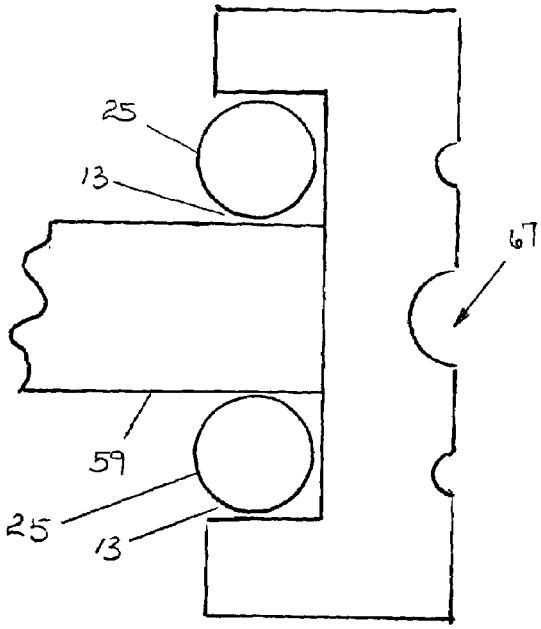

LIGHT ROPE CROWN MOLDING

This application claims the benefit of U.S. Provisional Application No. 60/505,109, filed Sep. 24, 2003.

BACKGROUND OF THE INVENTION

Currently methods of decorative, indirect interior or exterior lighting are often expensive, difficult to install and aesthetically unappealing. Methods exist for hanging strings of lights with hooks, clasps, and other similar devices. These systems often leave the wiring exposed and are not a visually attractive method of installing lighting.

Previous solutions to the need for indirect lighting involve complicated fluorescent lighting fixtures. Fluorescent apparatus are limited by the characteristics of fluorescent lighting, because fluorescent bulbs are mass-produced in limited sizes and the bulbs are rigid. Those considerations restrict the configurations available for decorative elements. Fluorescent lamps are relatively fragile and require substantial space surrounding the bulbs. Space is needed to insert or replace the lamps after the crown molding has been installed.

Light ropes are strings of small incandescent light bulbs within tubes of flexible material. Current methods of installing light ropes are inadequate due to the tendency of the light rope to sag in locations where there is no hook or other means of attachment to a surface. Additionally, light ropes that are viewed directly are not appropriate for every decorating scheme.

Needs exist for decorative indirect lighting methods and apparatus that are inexpensive and simple to install that add to the aesthetic appeal of a building.

SUMMARY OF THE INVENTION

The present invention is an apparatus for providing indirect illumination to a building interior, exterior or fixtures using crown molding with specialized grooves for holding light ropes or other types of light sources. The invention generally consists of modular pieces of crown molding, panel molding, etc. with an elongated groove in a top surface running parallel to the front surface. The groove may be cut into many forms of molding including currently available moldings from existing manufacturers. A light rope or other types of illumination are installed in the groove and provide indirect light on the wall above the crown molding and on the ceiling. The direction and intensity of the light can be affected by the shape and configuration of the groove. Additionally, the molding itself can be made of materials that allow specific amounts of light to pass through. Clips or other similar means hold the light rope or other source of illumination inside the groove.

The crown molding of the present invention can be made from molded plastic, wood, aluminum, ceramic, foam composite materials, stone, plaster, metals, fiberglass, cast urethane or any other suitable material. Before or after the molding is created, it can be stained, painted or otherwise colored and finished to match the building surroundings. A variety of decorating styles are accommodated.

The crown molding of the present invention has a front surface that is designed based on user preference and room design. The separate pieces of crown molding can be straight, 90-degree corners, other angled corners, vertically or horizontally curved sections, or any other configuration. The ends of straight pieces of molding can have mitered corners to fit any angle or corner. Existing clips or tracks can be fixed into place on the molding or a notch can be cut in the molding to fit a light source, eliminating the need for separately molding clips or tracks. Each piece of crown molding can be of any length that is appropriate for a specific room. The front face can have many different configurations based on the decor and personal preference of the building owner. The crown molding is connected to a wall surface via a generally flat back surface. The front and back surfaces do not have to be the same height and varying heights allow light to be directed in desired directions. Screws, nails, glue or other attachment means connect the back surface to the wall or surface.

The crown molding has a top surface with an elongated groove running parallel to the front surface. The crown molding can have either an "L" shape or a "U" shape. Any embodiment of the current invention can have either an "L" or "U" configuration. In the "L" shaped design, the groove is cut from the top corner of the molding, with one side of the groove being the wall. The base of the groove may be rounded or squared off. The "U" shaped design has a rounded or square bottom groove cut from the middle of the top surface. The groove is large enough to accommodate approximately ⅜", ½" or larger or smaller light ropes. The groove is sized differently depending on the size and shape of the light rope. Each piece of crown molding may have more than one groove for holding one or more light ropes. This produces a different lighting effect than single ropes.

Protrusions located along the length of the crown molding groove form clips that allow a user to snap the light rope into place. The clips prevent the light rope from shifting or warping and prevent the light rope from snaking, elongating, warping or extending above the rim of the groove. Existing clips or grooves can be utilized as well.

The rope lighting is connected to a building power source in one or more locations. A power connection is plugged into a wall socket or another source of electricity and then is run up to the crown molding. The power wire, cable or cord is passed through an opening in the crown molding. Alternatively, the power cord can be passed through the back surface of the molding and into the wall and connected to a power source there. Infrared power sources may also be used. The light rope may be of any length needed and is powered by the power connection. Multiple light ropes may be connected together if needed.

Other light sources may also be used. Fiber optic light sources can be disposed inside the groove. The fiber optic system allows the lights to change color according to user preference. Alternatively, a string of xenon light bulbs may be used. A string of independent light bulbs can be installed within the groove of the crown molding. The independent xenon bulbs are spaced about 1" apart and are long lasting to prevent the need for frequent changing of bulbs. Neon lighting may also be used for illumination. Also, LED lighting may be used for illumination.

Other embodiments of the present invention provide indirect illumination for alternative purposes. Decorative molding with grooves for light ropes or other light sources is used as complex crown molding with decorative relief. Decorative relief patterns are molded or cut into pieces of crown molding in the path of the indirect lighting coming from the light source. The indirect lighting creates patterns of shadows and light that are visually appealing.

In another embodiment, a rope light within the present crown molding may be attached below or along the bottom of existing crown molding to provide indirect lighting on the existing crown molding for aesthetic effect. The rope light may be contained in a smaller piece of material that is attached directly to the wall below the existing crown molding. The light cast by the light rope or other light source creates patterns of darkness and shadow for an appealing affect.

Alternatively, grooves can be molded into picture frames for casting light on the surfaces of artwork. Light ropes can be placed on one or all sides of a frame to illuminate paintings or other decorative elements. Molding may also be formed with grooves on shelving for illuminating objects placed on the shelving. Shelving may also have grooves for light ropes or other light sources contained within molding attached to the ends of shelves. One or more equal or unequal diameter light ropes can be placed in one or more grooves to illuminate the surfaces above or below the shelving.

The crown molding and rope lighting of the present invention may be used to provide decorative and safety lighting for railings and steps. Rope lighting is fixed in a groove running along one or more side of the underside of a railing. Lighting may also be installed in grooves along the overhangs of steps to provide illumination of the step below and to indicate where the steps are. These embodiments may be used in both interior and exterior environments.

These and further and other objects and features of the invention are apparent in the disclosure, which includes the above and ongoing written specification, with the drawings.

BRIEF DESCRIPTION OF THE DRAWINGS

FIG. 15 is an end view of a shelf with edge molding and a light rope.

FIGS. 16 and 17 are end views of a shelf with top and bottom light ropes showing various profiles.

DETAILED DESCRIPTION OF THE PREFERRED EMBODIMENTS

The present invention is an apparatus for providing indirect illumination to a building interior, exterior or fixtures using crown molding with specialized grooves for holding light ropes or other types of light sources. The invention generally consists of modular pieces of crown molding with an elongated groove in a top surface running parallel to a front surface. A light rope or other type of illumination is installed in the groove and provides indirect light on the wall, ceiling or other object above or below the light source. The direction and intensity of the indirect lighting is adjusted by altering the size and orientation of the groove and the shape of the molding. Clips hold the light rope or other source of illumination inside the groove. Existing clips or tracks can be used.

The crown molding of the present invention can be made from molded plastic, wood, aluminum, ceramic, foam composite materials, stone, plaster, metals, fiberglass, cast urethane or any other suitable material. Before or after the molding is created, it can be stained, painted or otherwise colored and finished to match the building surroundings. A variety of decorating styles are accommodated. The crown molding itself may be flexible to create unusual decorative patterns, including rounded arches for over doorways and interiors or exteriors of windows. The molding may be made of semi-transparent materials to allow some light to pass through the molding itself, thus providing additional illumination and an alternative lighting effect.

Figure 1:
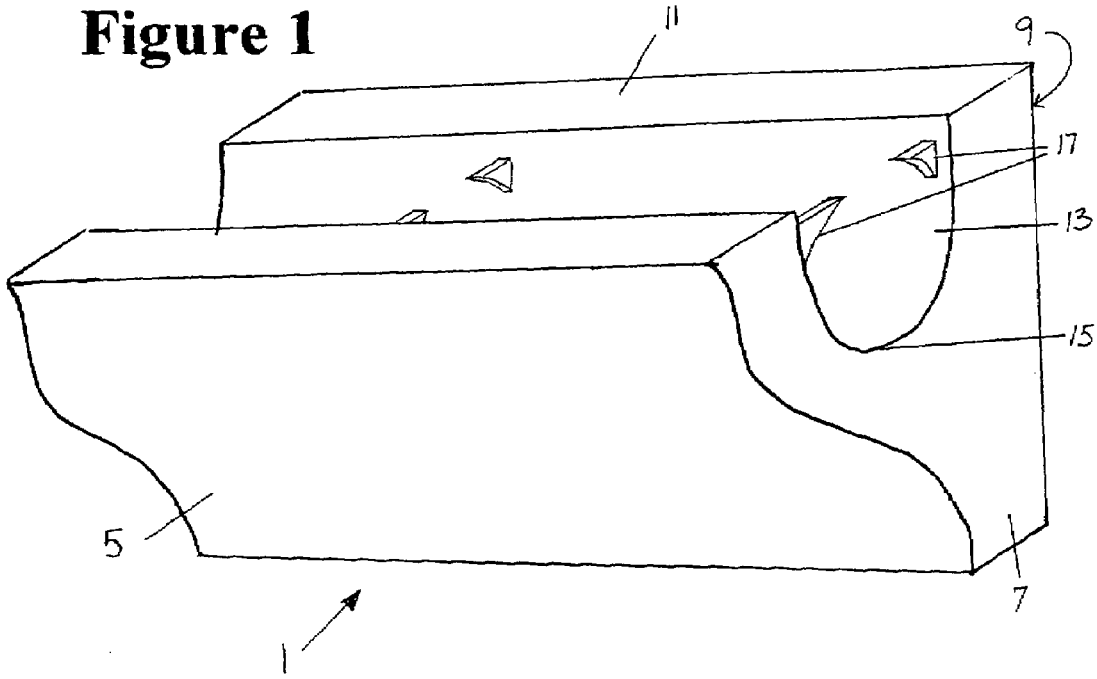
FIG. 1 is a perspective view of a straight section of crown molding.
Figure 2:
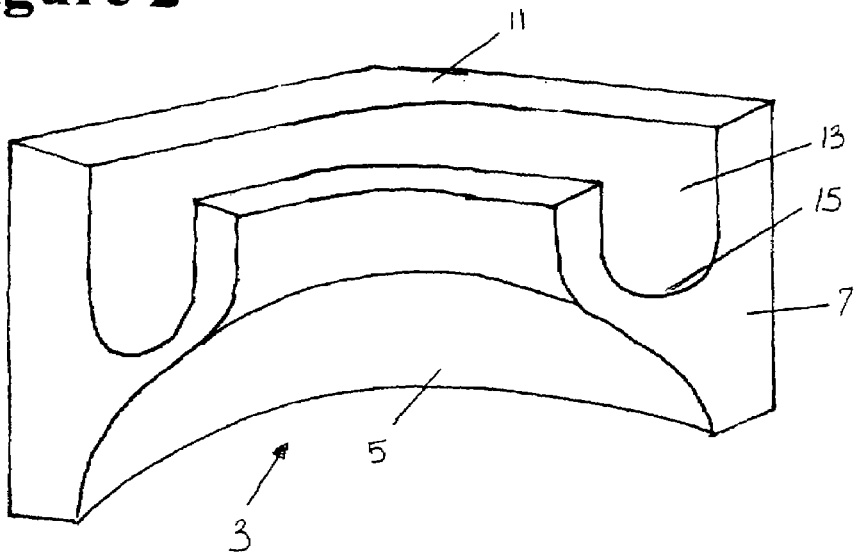
FIG. 2 is a perspective view of a 90-degree corner section of crown molding.

FIG. 1 shows a straight section of crown molding 1. FIG. 2 shows a 90-degree corner section of crown molding 3. The crown molding of the present invention has a front surface 5 that is designed to match user preferences and room designs. The separate pieces of crown molding 1 can be straight, 90-degree corners, other angled corners, vertically or horizontally curved sections, or any other configuration. The ends 7 of straight pieces of molding can have flat ends or mitered corners to fit various angled corners of a room. Each piece of crown molding can be of any length that is appropriate for a specific room.

The front face 5 can have many different configurations based on the decor and personal preference of the building owner. The crown molding is connected to a wall surface via a generally flat back surface 9. The front 5 and back 9 do not need to be of the same general height. Altering the height difference between the front 5 and back 9 surfaces creates different lighting results and changes the direction in which the light is focused. Screws, nails, glue or other attachment means connect the back surface 9 to the wall or surface.

The crown molding has a top surface 11 with an elongated groove 13 running parallel to the front surface 5. The groove 13 is large enough to accommodate approximately ⅜", ½" or larger or smaller light ropes. The bottom 15 of the groove 13 is rounded or squared off in any embodiment of the present invention. The groove 13 is sized differently depending on the size and shape of the light rope. Protrusions 17 are located along the length of the crown molding groove 13 and form clips that allow a user to snap the light rope into place. Additionally, existing clips or tracks can be used, thus, eliminating the need for new clips or tracks. The clips 17 prevent the light rope from shifting or warping and prevent the light rope from extending above the rim of the groove.

Figure 3:
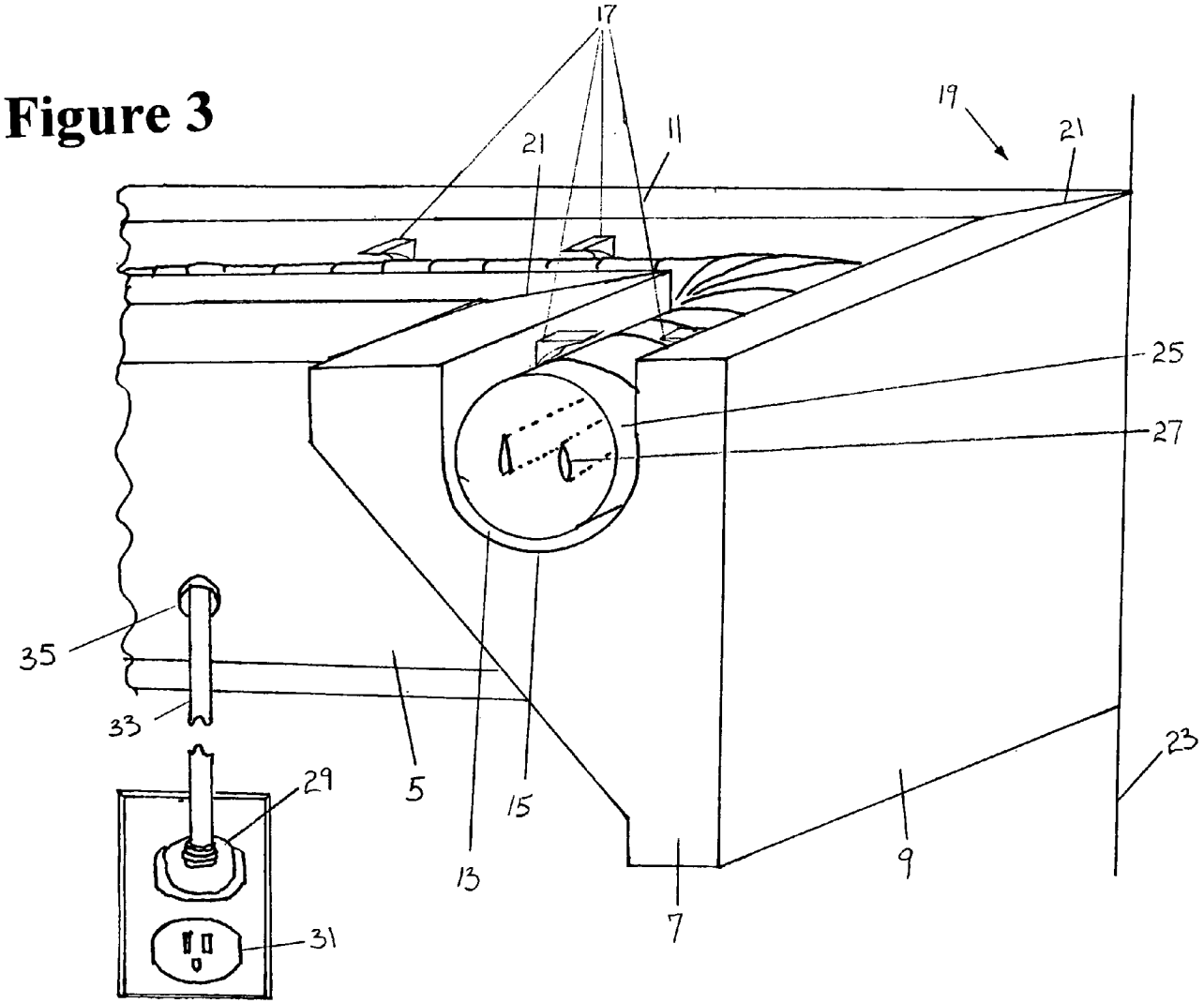
FIG. 3 is a perspective view of a corner section of crown molding with a light rope installed and an electric connection.
Figure 4:
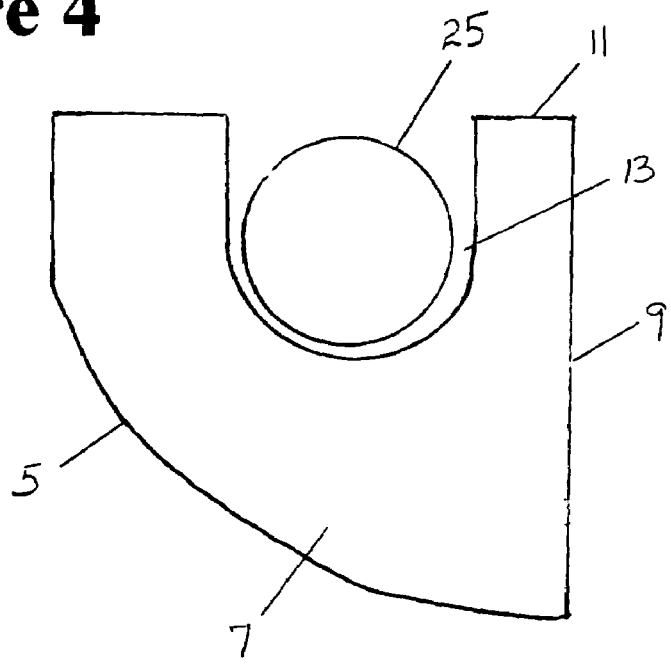
FIGS. 4–7 are end views of "U" shaped crown molding showing various profiles.
Figure 5:
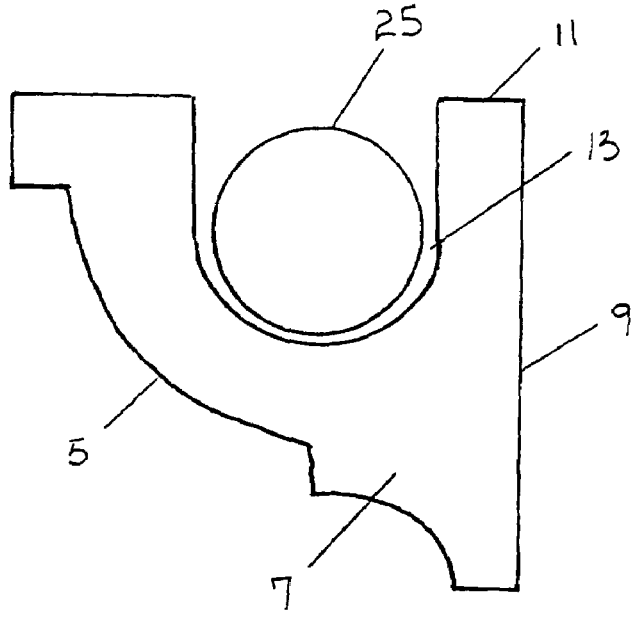
Figure 6:
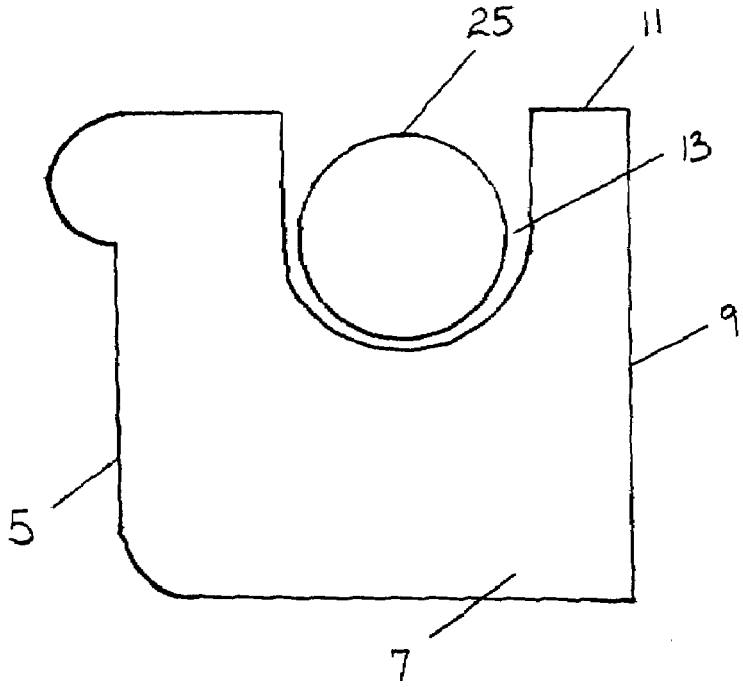
Figure 7:
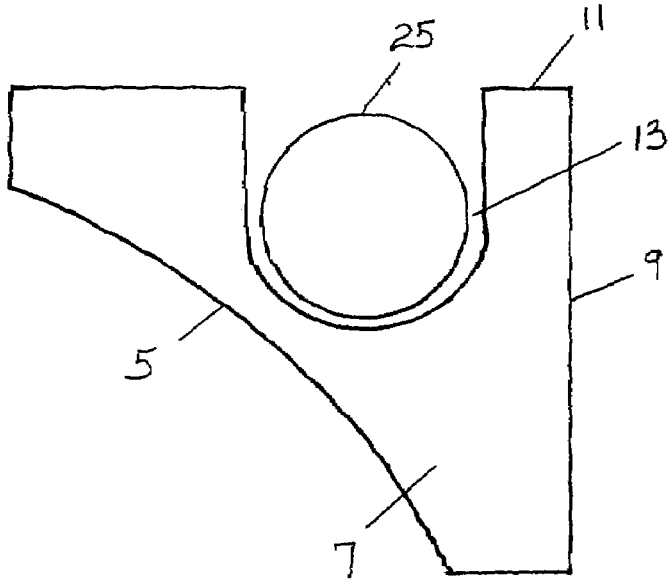
Figure 8:
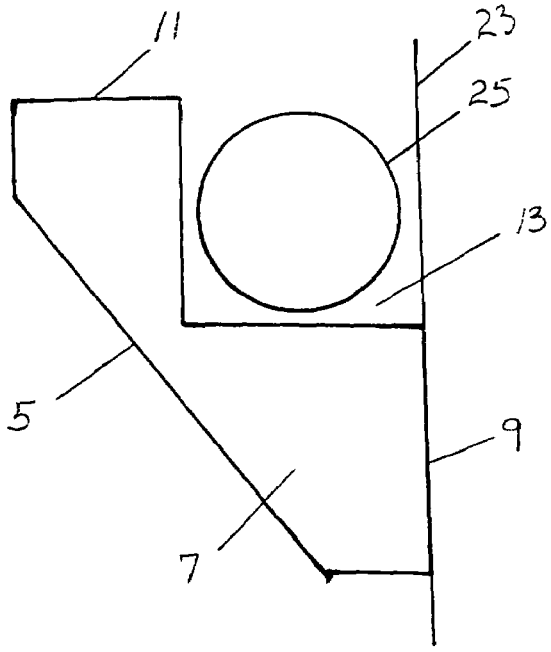
FIGS. 8–11 are end views of "L" shaped crown molding showing various profiles.
Figure 9:
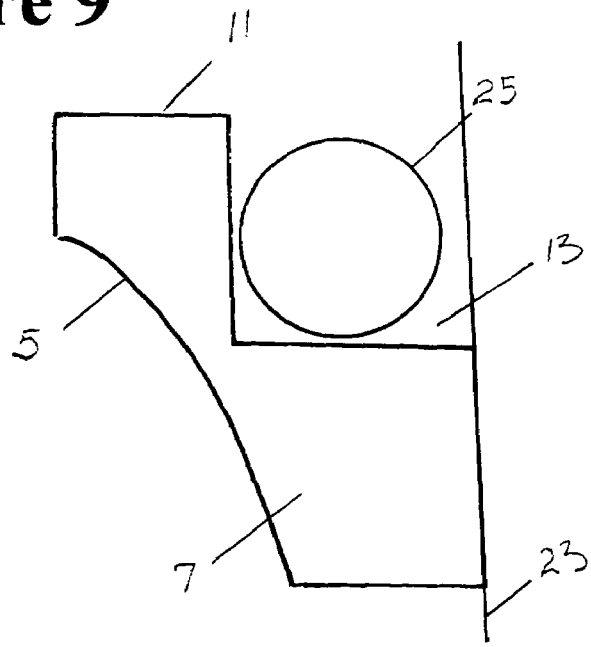
Figure 10:
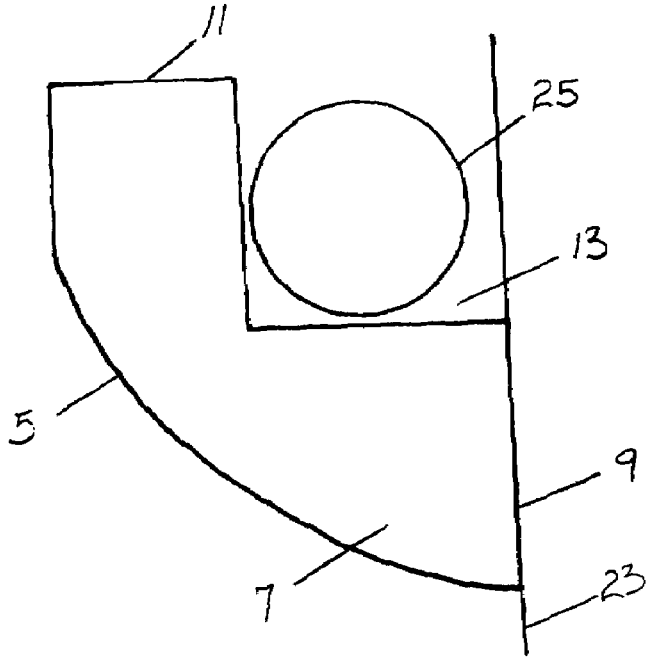
Figure 11:
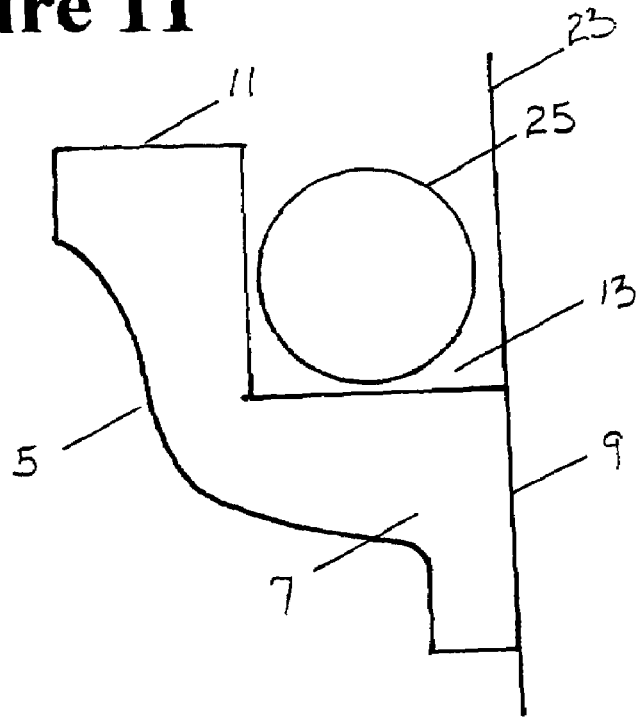

FIG. 3 shows a corner connection 19 between two segments of crown molding. The ends of the two segments of crown molding are mitered 21 to fit the corner of a wall 23. A rope light 25 is snapped into place with clips 17 within the groove 13. The rope lighting 25 has wires 27 running through its length with light bulbs at set intervals. At one or more points, the rope light 25 is connected to a building power source. There may be one or more rope lights within the crown molding. Multiple sets of rope lighting 25 may be used and connected together. The rope lighting 25 is flexible enough to conform to various corner profiles and radii.

A power connection 29 is plugged into a wall socket 31 or another source of electricity and then is run up to the crown molding. The power wire 33, cable or cord is passed through an opening 35 in the crown molding. Alternatively, the power wire 33 may be run through the back surface 9 of the crown molding and directly into the wall 23. The power wire 33 is then connected directly to the household power source or to a different outlet 31. The light rope 25 may be of any length needed and is powered by the power connection 29. Multiple light ropes 25 may be connected together if needed to fill the crown molding. Power may also be supplied via infrared remote power supplies.

Various decorative forms of crown molding may be used, as shown in FIGS. 4 through 7. FIGS. 4–7 show "U" shaped configurations for crown molding with rounded bottom grooves 13. The bottom of the groove 13 may also be squared off in any embodiment. The grooves 13 are designed to accommodate various light rope 25 profiles. The front face 5 of the crown molding can be manufactured to match existing decor or to provide architectural accents. In all forms, the light rope 25 is snapped into the groove 13 for providing indirect lighting upward. The configuration of the top surface 11 of the molding affects the direction of the indirect lighting.

FIGS. 8–11 show an "L" shaped configuration. The groove 13 is rounded or squared off and is cut from the upper corner of the molding with the wall 23 forming one side of the groove 13. The wall 23 holds the lighting in place and completes the groove 13. Reflectors or other optical devices can be placed within the groove 13 of any form of crown molding to provide increased illumination, distinct lighting effects and redirection of light.

Double grooved crown molding may also be used for different lighting effects. One or more grooves 13 may be cut or molded into the crown molding 1 to accommodate one or more lighting systems. The grooves 13 can be cut in parallel with separate lighting elements 25 in each groove 13. The double lighting provides additional illumination and a different effect.

Figure 12:
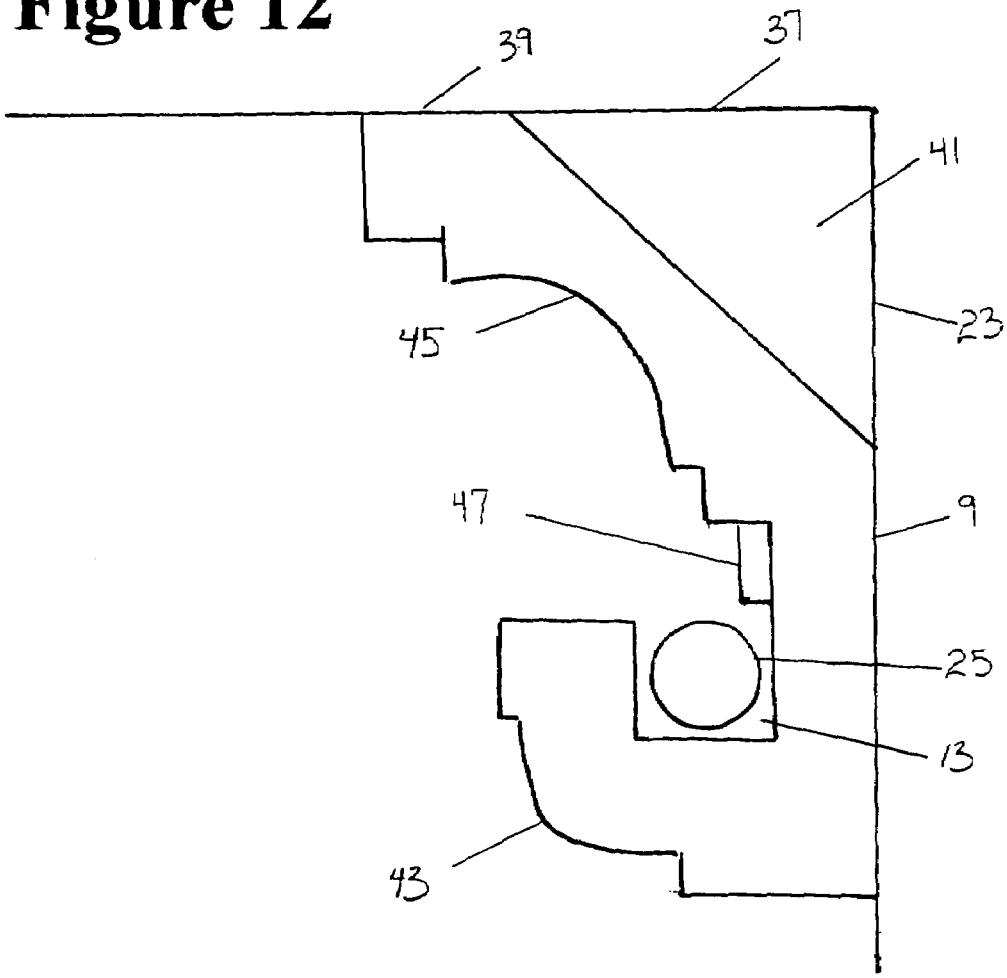
FIG. 12 is an end view of a crown molding section with decorative relief and lighting.

FIG. 12 shows a more complex design of one piece crown molding. The section of crown molding is attached to the wall 23 at the back surface 9. The crown molding then extends upwards and is connected to the ceiling 37 at an upper surface 39. An empty space 41 may be left between the molding, wall 23 and ceiling 37. The crown molding has a lower front face 43 and an upper front face 45 that are designed to match the desired decor of the room. A light rope 25 or other light source is installed in a groove 13 below the upper front face 45. Decorative relief 47 is molded or cut into the molding above the indirect light source 25. The lighting creates areas of shadows and light that creates a unique decorative element. The crown molding of the present invention can also be attached directly to existing decorative relief molding to provide illumination effects.

Figure 13:
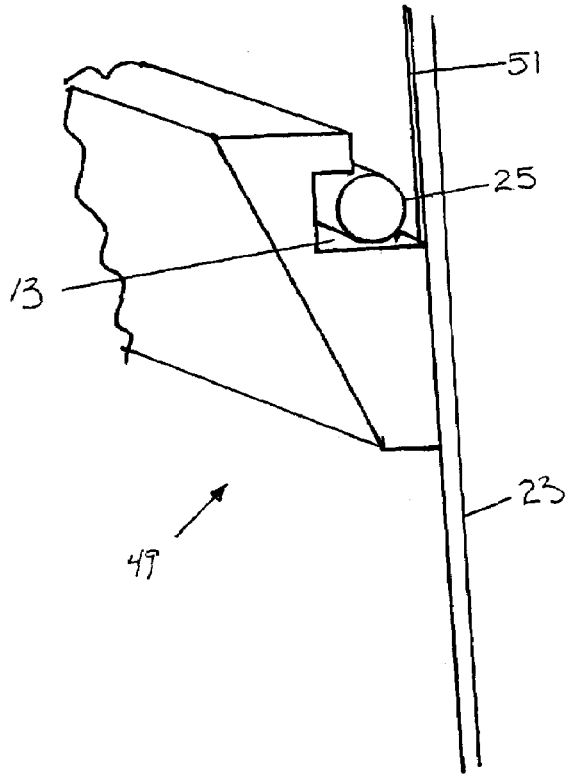
FIG. 13 is a perspective view of a picture frame segment with a light rope.

FIG. 13 shows a picture frame 49 with a light rope 25 in a groove 13. The picture frame 49 extends around a painting 51 or other object. Indirect lighting from the light source 25 illuminates the surfaces above the groove 13. The picture frame 49 does not need to be mounted directly to the wall, but instead can be hung like a normal picture frame. Lighting 25 may be provided along one or all sides of the frame 49. This type of indirect light could be used for picture frames, panel molding or chair-rail molding.

Figure 14:
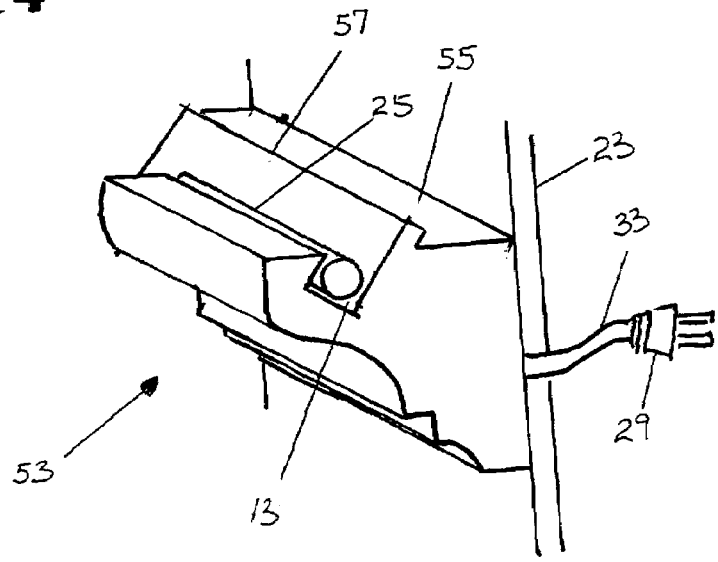
FIG. 14 is a perspective view of a shelf segment with a light rope.

FIG. 14 shows a shelf 53 with a groove 13 for holding a light rope 25 or other light source. The shelf 53 has one or more horizontal surfaces 55. The groove 13 can be located at any point along the horizontal surface 55. A ridge 57 for holding pictures or other objects can be provided in the shelf 53. The shape and orientation of the groove 13 allows for different lighting effects depending on the user's preference.

FIGS. 15–17 show different illumination configurations for molding attached to ends of shelves 59. FIG. 15 shows a shelf 59 attachment 61 that provides illumination below the shelf 59. The attachment 61 has a front face 63 configuration that matches the room decor. The groove 13 is created to direct light in a desired direction. This type of molding could be used to decorate the ends of cabinetry shelves and to illuminate the contents of the cabinets for display. FIG. 16 shows an attachment 65 for accommodating two light ropes 25. The light ropes 25 and the corresponding grooves 13 do not need to be of equal size. FIG. 17 shows an alternate configuration of molding 67, showing vertical/horizontal radius, with two equal sized light ropes 25 and grooves 13. These configurations are adjusted to provide individualized lighting solutions. The grooves 13 in the molding can have various shapes and configurations to change the lighting effect.

Figure 18:
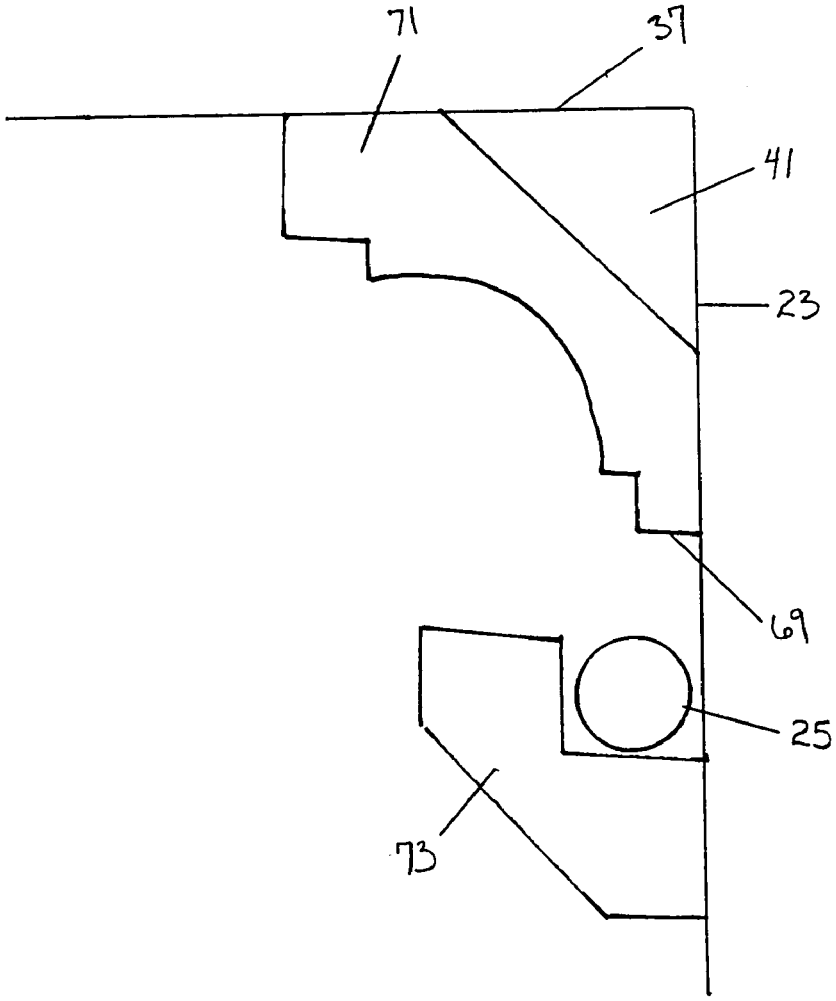
FIG. 18 is an end view of a light rope holder under existing crown molding.

In another embodiment, shown in FIG. 18, a rope light 25 may be attached along the bottom 69 of existing crown molding 71 to provide indirect lighting on the existing crown molding 71 for aesthetic effect. The rope light 25 may or may not be contained within a separate piece of molding 73. The rope light 25 may be contained in a smaller piece of material 73 that is attached directly to the wall 23 below the existing crown molding 71. The material 73 covers the light rope 25 except for a channel where the light from a light rope 25 escapes. The light cast by the light rope 25 or other light source creates patterns of darkness and shadow for an appealing affect. Relief molding may be located between the light rope 25 and the bottom of the existing crown molding 69 for lighting effects.

Figure 19:
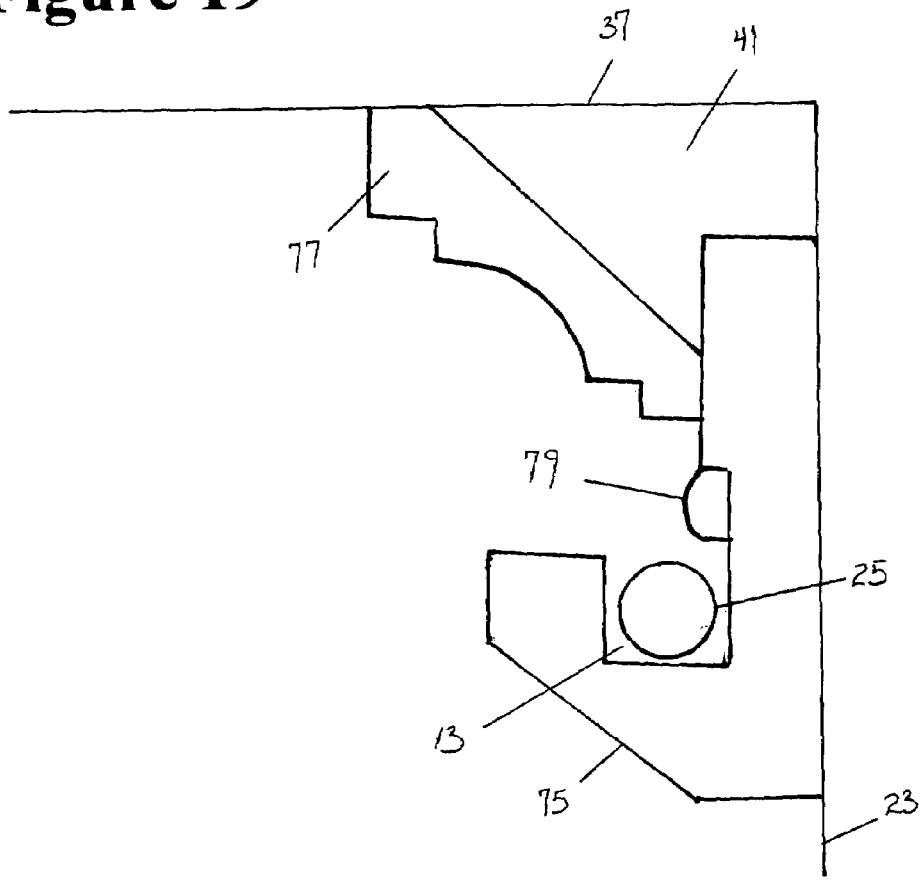
FIG. 19 is an end view of light rope crown molding with decorative relief attached to separate crown molding.

FIG. 19 shows a piece of molding 75 with a rope light 25 in a groove 13 attached to a piece of separate crown molding 77 to provide indirect lighting on the existing crown molding 71 for aesthetic effect. The molding 75 is attached directly to the wall 23, below the ceiling 37. The crown molding 77 is connected between the ceiling 37 and the molding 75. Relief molding 79 is attached to the molding 75 below the crown molding 77 and above the light rope 25. Light escapes from the groove 13 and illuminates both the relief molding 79 and crown molding 77. The light cast by the light rope 25 or other light source creates patterns of darkness and shadow for an appealing affect.

Figure 20:
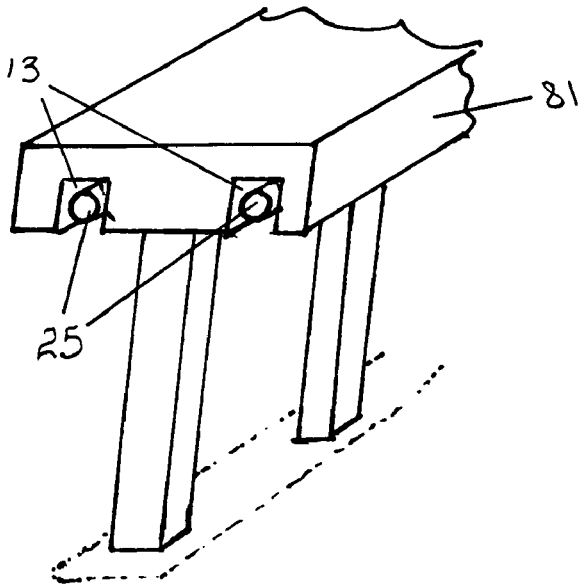
FIG. 20 is a perspective view of a railing with light ropes underneath.

FIG. 20 shows the lighted molding of the present invention used on a banister or railing 81. One or more light ropes 25 may be used on one or more locations of the banister or railing 81. The lighting can illuminate the railing itself of the area surrounding it.

Figure 21:
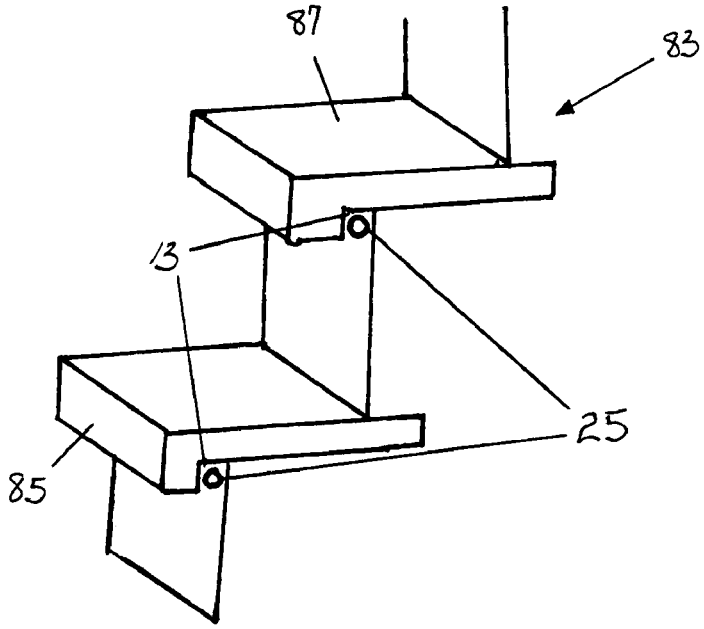
FIG. 21 is a perspective view of a staircase with rope lighting illuminating the lower steps.

FIG. 21 shows the lighted molding of the present invention used on a stairway 83. The rope lights 25 are located on the underside of the overhang 85 of each step 87. The light ropes 25 are fitted and secured into grooves 13 on the underside of the steps 87. Lighting is provided on the lower step for safety and aesthetic appeal.

Other light sources besides light ropes may be used. Fiber optic light sources can be disposed inside the groove 13. The fiber optic system allows the lights to change color according to user preference. Alternatively, strings of xenon light bulbs may be used. A string of independent light bulbs can be installed within the groove of the crown molding. The independent xenon bulbs are spaced about 1" apart and are long lasting to prevent the need for frequent changing of bulbs. Neon bulbs may also be used.

While the invention has been described with reference to specific embodiments, modifications and variations of the invention may be constructed without departing from the scope of the invention.

I claim:

1. A light bearing molding apparatus comprising:

at least one piece of molding, at least one groove cut into the at least one piece of molding for holding a flexible light source, a flexible light source for providing illumination, an egress connecting an exterior surface of the molding to the at least one groove for passage of a power source for the flexible light source.

2. The apparatus of claim 1, wherein the at least one piece of molding further comprises crown molding.

3. The apparatus of claim 1, wherein the at least one piece of molding further comprises chair rail.

4. The apparatus of claim 1, wherein the at least one groove further comprises at least one U-shaped groove.

5. The apparatus of claim 4, wherein the at least one U-shaped groove further comprises at least one U-shaped groove cut into a middle of a top surface.

6. The apparatus of claim 4, wherein the at least one U-shaped groove further comprises at least one U-shaped groove with a squared bottom.

7. The apparatus of claim 1, wherein the at least one groove further comprises at least one L-shaped groove.

8. The apparatus of claim 7 wherein the at least one groove further comprises at least one groove formed in the back corner of the top surface.

9. The apparatus of claim 7 wherein the at least one L-shaped groove further comprises at least one L-shaped groove with a rounded bottom.

10. The apparatus of claim 1 wherein the flexible light source further comprises a light rope.

11. The apparatus of claim 1 wherein the flexible light source further comprises a fiber optic light source.

12. The apparatus of claim 1 wherein the flexible light source further comprises a string of xenon light bulbs.

13. The apparatus of claim 1 wherein the egress for passage of a power source further comprises an egress cut into the front surface of the molding.

14. The apparatus of claim 1 wherein the egress for passage of a power source further comprises an egress cut into the rear surface of the molding.

15. The apparatus of claim 1 wherein the molding further comprises picture frame molding.

16. The apparatus of claim 1 wherein the molding further comprises shelf molding.

17. A light bearing railing apparatus comprising:

at least one piece of rail, at least one groove cut into the at least one piece of rail for holding a flexible light source, a flexible light source for providing illumination, an egress connecting an exterior surface of the rail to the groove for passage of a power source for the flexible light source.

18. The apparatus of claim 17 wherein the flexible light source further comprises light ropes.

19. The apparatus of claim 17 wherein the flexible light source further comprises a fiber optic light source.

20. The apparatus of claim 17 wherein the flexible light source further comprises a string of xenon light bulbs.

21. The apparatus of claim 1 wherein the molding further comprises a horizontal strip of molding spaced below a crown molding.

22. The apparatus of claim 1 further comprising clips within the at least one groove for securing the flexible light source.

23. The apparatus of claim 17 further comprising clips within the at least one groove for securing the flexible light source.

* * * * *